US006773223B2

(12) United States Patent
Harris et al.

(10) Patent No.: US 6,773,223 B2
(45) Date of Patent: Aug. 10, 2004

(54) HYDRAULIC ATTACHMENT LATCH MECHANISM FOR SKID STEER LOADER

(75) Inventors: William L. Harris, Paradise, PA (US); Joe E. Shriver, New Holland, PA (US)

(73) Assignee: New Holland North America, Inc., New Holland, PA (US)

( * ) Notice: Subject to any disclaimer, the term of this patent is extended or adjusted under 35 U.S.C. 154(b) by 68 days.

(21) Appl. No.: 10/146,810

(22) Filed: May 17, 2002

(65) Prior Publication Data

US 2003/0215320 A1 Nov. 20, 2003

(51) Int. Cl.[7] ..... E02F 3/28
(52) U.S. Cl. ..... 414/723; 37/468; 91/189 R
(58) Field of Search ..... 414/723; 37/468; 41/189 R, 517, 512

(56) References Cited

U.S. PATENT DOCUMENTS

| | | | | |
|---|---|---|---|---|
| 2,844,942 A | | 7/1958 | Reynolds | |
| 3,203,565 A | | 8/1965 | Keskitalo | |
| 3,204,793 A | | 9/1965 | Lane | |
| 3,272,264 A | | 9/1966 | Antolini | |
| 4,240,647 A | | 12/1980 | Lewis | |
| 4,586,867 A | | 5/1986 | Stafford | |
| 4,726,731 A | * | 2/1988 | Jones | 414/723 |
| 5,310,275 A | | 5/1994 | Lovitt | |
| 5,562,397 A | | 10/1996 | Albright | |
| 5,590,731 A | | 1/1997 | Jacobson | |
| 5,769,596 A | | 6/1998 | Burton | |
| 5,813,311 A | | 9/1998 | Toyooka et al. | |
| 6,132,131 A | | 10/2000 | Nakamura et al. | |
| 6,196,595 B1 | | 3/2001 | Sonerud | |
| 6,332,747 B1 | | 12/2001 | Lee | |

* cited by examiner

*Primary Examiner*—Donald W. Underwood
(74) *Attorney, Agent, or Firm*—John William Stader; Collin A. Webb

(57) ABSTRACT

A work vehicle including at least one implement lifting arm connected to an implement and a hydraulic implement circuit, the implement circuit having a pump and a fluid reservoir connected to conduits of the implement circuit. The implement circuit further includes at least one implement cylinder, the implement cylinder being connected to the conduits of the implement circuit so as to be powered by the pump; and a latch mechanism comprising a latch valve with integral sequence valve mechanism, wherein the latch valve is connected to receive fluid from the implement cylinder, and a latch cylinder is connected to receive fluid from the latch valve, wherein the latch mechanism operates to securely connect the implement at one end of the at least one lifting arm when the implement cylinder is in a first state and the latch valve is operated to direct fluid to the latch cylinder.

18 Claims, 5 Drawing Sheets

HYDRAULIC ATTACHMENT LATCH MECHANISM FOR SKID STEER LOADER

FIELD OF THE INVENTION

The invention relates generally to a latch mechanism for an implement connected to a work vehicle, such as, for example, a bucket connected to a skid steer loader. More particularly, the invention relates to an improved hydraulic circuit for operating a hydraulic latch mechanism for securing an implement to the pivoting lift arms of a work vehicle, wherein the latch mechanism includes a solenoid operated hydraulic latch valve with integral sequence valve mechanism for operating a latch cylinder that moves the latch pin.

BACKGROUND OF THE INVENTION

In the art of manufacturing work vehicles such as skid steer loaders, tractors, etc. that are constructed to have pivoting lift arms or booms attached at one end to the body of the vehicle, it is known that a coupler is often used to attach an implement to the distal end of the lifting arms or booms. The coupler serves as a connector to which an implement is operationally connected; however, in some vehicles the implement is connected directly to the distal end of the lifting arms or booms. In this manner, various implements such as a loader bucket, a grader, an auger, a broom, or other working implement attachment can be interchangeably connected to the work vehicle for the purpose of replacement, maintenance, or simply to change the implement attachment to meet the particular job requirement. In other words, for example, the coupler permits an operator to place a bucket on the work vehicle when digging is required, or a grader on the vehicle when earth leveling is desired, and so forth.

When the desired implement is connected to the coupler (also known as an "implement mounting plate") or directly to the distal ends of the lifting arms, typically a latch pin mechanism is used to secure the implement in place. For example, U.S. Pat. No. 3,204,793 to Lane (specifically incorporated herein in its entirety by reference) discloses a front end loader that has an implement attachment apparatus that includes a pair of hydraulic cylinders for moving corresponding piston rods to lock an implement in operative engagement with a hitch member. Although hydraulic tubes are disclosed, the Lane Patent is silent with respect to what specific hydraulic mechanism is used for activating the hydraulic cylinders.

U.S. Pat. No. 3,203,565 to Keskitalo (specifically incorporated herein in its entirety by reference) discloses various latch mechanism structures for connecting a side dump bucket to a vehicle mounted loader. Each latch mechanism structure includes a hydraulic jack and cooperating locking rod that are used to selectively attach one or both bars of the bracket members to a cradle to prevent pivotal movement of the cradle. The cradle is supported by lifting arms that impart lifting and/or tilting movements to the cradle in a conventional manner. The cradle supports a dump bucket as is known in the art. Like Lane, the Keskitalo Patent is silent with respect to the hydraulic circuit that is used to operate the disclosed latch mechanism structure.

U.S. Pat. No. 6,132,131 to Nakamura et al. discloses an attachment mounting/demounting device for a work vehicle, wherein a bucket implement is connected to the boom of a work vehicle by means of the mounting/demounting device. The mounting/demounting device includes a rocker arm rocked by a mounting/demounting cylinder and a lock piston that is advanced or retracted depending upon the condition of a hydraulic circuit. The hydraulic circuit includes a selector valve connected to a hydraulic pump and an oil tank, and a 4/2 solenoid operated spring biased switching valve connected to the selector valve. The switching valve operates both the mounting/demounting cylinder and the lock piston, which incorporates the features of a pilot operated spring biased 2/2 valve.

In operation, the rocker arm and the lock piston move together to either secure the bucket implement or to release the bucket implement depending upon the state of the switching valve. Because the switching valve is electronically controlled by a single select switch, the mounting/demounting device disclosed by the Nakamura et al. Patent is prone to accidental activation. Furthermore, the hydraulic circuit of the device is separate from the other hydraulic systems used to operate the work vehicle, which is a drawback because the structure does not take advantage of other necessary hydraulic circuits. In other words, it would be more cost efficient to incorporate the hydraulic circuit of the mounting/demounting device into a previously existing hydraulic circuit such as for moving the boom.

A non-hydraulic latch pin mechanism is disclosed in U.S. Pat. No. 5,769,596 to Burton, wherein shiftable pins are moved into and out of a latching relation with the implement that is being attached to the work vehicle when an electrically powered linear actuator moves the shiftable pins. Such an electrically operated and powered latch pin mechanism has the drawback that it is relatively slow, places a drain on the vehicle's electrical system, and requires the addition of an expensive electric motor for each shiftable pin.

U.S. Pat. No. 5,562,397 to Albright discloses another electric latch pin mechanism for attaching an attachment to an attachment frame of a skid steer loader, which shares many of the drawbacks of the mechanism disclosed by Burton. Albright suggests that a hydraulic actuator could be substituted for the electric motor driven power actuator on the attachment plate; however, Albright does not suggest all of the features of the hydraulic attachment latch mechanism in accordance with the present invention. U.S. Pat. No. 5,562,397 to Albright is also incorporated herein by reference in its entirety.

The present invention provides an improved hydraulic circuit for operating a hydraulic latch mechanism, wherein the latch mechanism includes a solenoid operated hydraulic latch valve with integral sequence valve for operating a latch cylinder that moves one or more latch pins. The present invention endeavors to overcome the drawbacks of the prior art latch mechanisms.

Accordingly, a primary object of the present invention is to overcome the disadvantages of the prior art latch mechanisms.

Another object of the present invention is to provide a latch mechanism that is incorporated into a hydraulic circuit for operating the lift arms of a work vehicle.

A further object of the present invention is to provide a latch mechanism that is incorporated into a hydraulic circuit for operating the mount plate tilt mechanism that is cost efficient to manufacture, easy to maintain, and durable because the structure minimizes the need for additional components such as extra hydraulic plumbing and electrical wiring.

A still further object of the present invention is to provide a latch mechanism that requires two simultaneous and conscious actions to be performed by the operator of the work vehicle in order to activate the latch mechanism to virtually eliminate the possibility of inadvertently activating the latch mechanism.

Yet another object of the present invention is to provide a latch mechanism that provides an over-center mechanism so that any loss of hydraulic pressure will have no effect on the security of the latch of the latch mechanism.

SUMMARY OF THE INVENTION

In accordance with the above objectives, the present invention provides a work vehicle characterized by: (1) at least one implement lifting arm connectable to an implement and (2) a hydraulic implement circuit for powering the implement, the hydraulic implement circuit having a hydraulic pump and a hydraulic fluid reservoir connected to hydraulic conduits of the hydraulic implement circuit, wherein the hydraulic pump is connected to pump hydraulic fluid from the reservoir through the conduits of the hydraulic implement circuit, wherein the implement circuit further comprises: (3) at least one hydraulic implement cylinder for maneuvering the implement, the at least one implement cylinder being connected to the conduits of the implement circuit so as to be powered by the hydraulic pump; and (4) a latch mechanism comprising a latch valve with integral sequence valve mechanism and a latch cylinder, wherein the latch valve is connected to receive hydraulic fluid from the at least one implement cylinder, and the latch cylinder is connected to receive hydraulic fluid from the latch valve, wherein the latch mechanism operates to securely connect the implement at one end of the at least one lifting arm when the at least one implement cylinder is in a first state and the latch valve is operated to direct hydraulic fluid to the latch cylinder.

In a second preferred embodiment of the invention, the first preferred embodiment is modified so that the first state is a fully retracted state.

In a third preferred embodiment of the invention, the first preferred embodiment is modified so that the latch valve is disposed along a coupler.

In a fourth preferred embodiment of the invention, the first preferred embodiment is modified so that the latch valve is a solenoid activated spool valve with integral sequence valve.

In a fifth preferred embodiment of the invention, the first preferred embodiment is modified so that the latch valve is a solenoid-operated, spring-biased 4/3 spool valve mechanism in parallel with a sequence valve mechanism.

In a sixth preferred embodiment of the invention, the first preferred embodiment is modified so that the latch cylinder has a piston that moves into an extended position when the latch mechanism operates to securely connect the implement at one end of the at least one lifting arm.

In a seventh preferred embodiment of the invention, the sixth preferred embodiment is modified so that at least one remote latch pin is mechanically connected to the piston so that the at least one remote latch pin moves into an extended position to securely connect the implement at one end of the at least one lifting arm when the piston moves into the extended position.

In an eighth preferred embodiment of the invention, the sixth preferred embodiment is modified so that two remote latch pins are mechanically connected by a connection assembly to the piston so that each remote latch pin moves into an extended position to securely connect the implement at one end of the at least one lifting arm when the piston moves into the extended position.

In an ninth preferred embodiment of the invention, the seventh preferred embodiment is modified so that the latch mechanism includes a first lever arm connected to the piston and a second lever arm connected to the base end of the latch cylinder so that the at least one remote latch pin is maintained in the extended position when the latch cylinder is relaxed.

In a tenth preferred embodiment of the invention, a hydraulic circuit for a work vehicle is characterized by (1) a hydraulic pump and a hydraulic fluid reservoir connected to hydraulic conduits of the hydraulic implement circuit, wherein the hydraulic pump is connected to pump hydraulic fluid from the reservoir through the conduits of the hydraulic implement circuit; (2) a first hydraulic implement cylinder arranged to maneuver the implement, the first implement cylinder being connected to the conduits of the implement circuit so as to be powered by the hydraulic pump; and (3) a latch mechanism including a latch valve with integral sequence valve mechanism and a latch cylinder, wherein the latch valve is connected to receive hydraulic fluid from the at least one implement cylinder, and the latch cylinder is connected to receive hydraulic fluid from the latch valve, wherein the latch mechanism operates to position a latching when the at least one implement cylinder is in a first state and the latch valve is operated to direct hydraulic fluid to the latch cylinder.

In an eleventh preferred embodiment of the present invention, the tenth preferred embodiment is modified so that the hydraulic circuit is hydraulically connected to a main hydraulic circuit of the work vehicle so that the pump and the reservoir are connected to and are part of the main hydraulic circuit.

The tenth preferred embodiment of the invention can be further modified in a manner in accordance with the various modifications of the first preferred embodiment of the invention.

In a twelfth preferred embodiment of the invention, a hydraulic latch mechanism hydraulically connectable to a hydraulic circuit of a work vehicle, wherein the hydraulic circuit is connectable to provide hydraulic fluid to power the hydraulic latch mechanism, is characterized by (a) a solenoid-activated latch valve with integral sequence valve mechanism wherein the latch valve includes an intake connectable to receive hydraulic fluid from the hydraulic circuit so that the integral sequence valve mechanism senses hydraulic pressure load provided by the hydraulic circuit to the intake; and (b) a hydraulic latch cylinder connected to receive hydraulic fluid from the latch valve so that (1) when hydraulic pressure load provided by the hydraulic circuit to the intake exceeds a minimum threshold pressure load and (2) when a solenoid mechanism of the latch valve is selectively activated, then hydraulic fluid is directed by the latch valve to the latch cylinder to activate the latch cylinder to extend a first pin to a latching position.

In a thirteenth preferred embodiment of the invention, the twelfth preferred embodiment is modified so that the first pin is mechanically connected by a connection assembly to two remote pins so that when the first pin extends, the two remote pins extend simultaneously to a latching position.

In a fourteenth preferred embodiment of the invention, the twelfth preferred embodiment is modified so that the minimum threshold pressure load is exceeded when at least one implement cylinder of the hydraulic circuit is in a fully retracted state.

In a fifteenth preferred embodiment of the invention, the twelfth preferred embodiment is modified so that the latch valve and the latch cylinder are disposed along a mount.

Further objects, features and advantages of the present invention will become apparent from the Detailed Description of Preferred Embodiments, which follows, when considered together with the attached drawings.

DETAILED DESCRIPTION OF THE PREFERRED EMBODIMENTS OF THE INVENTION

Figure 1:
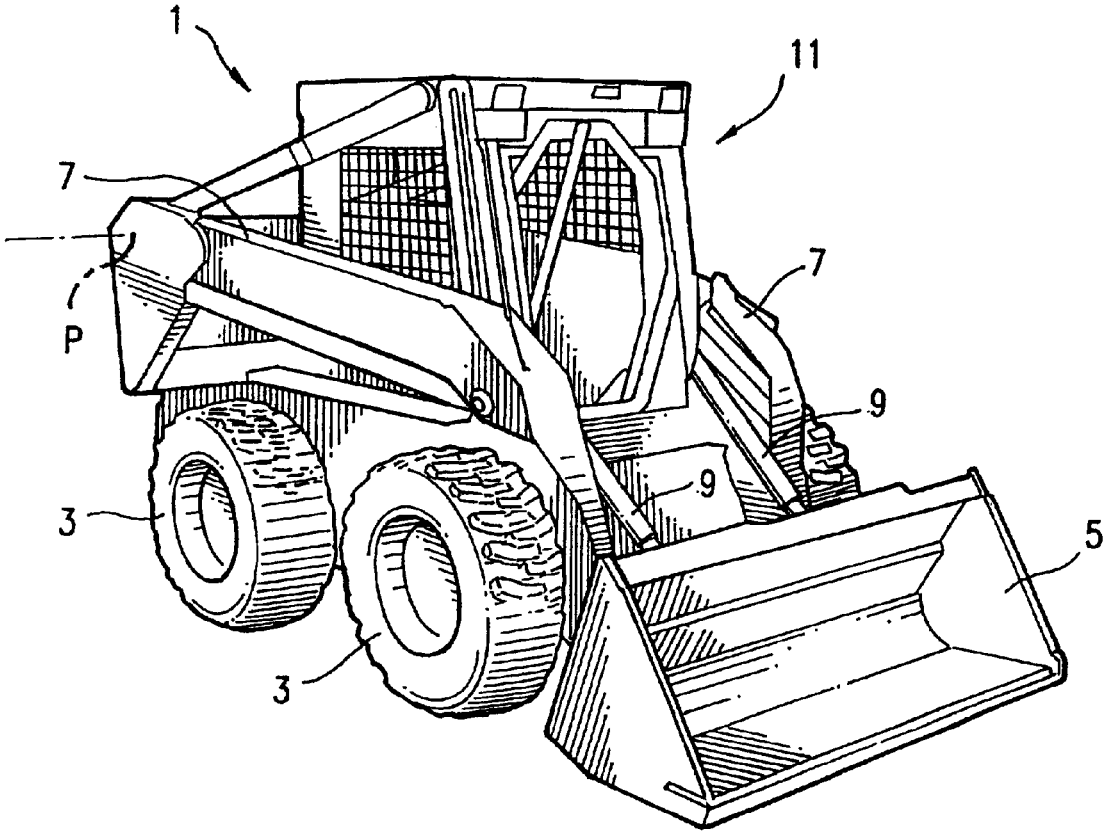
FIG. 1 is a perspective view of one embodiment of the work vehicle in accordance with the present invention.

The preferred embodiments of the invention will now be described with reference to the Figures in which like parts are indicated by like reference numerals. The apparatus of the present invention is a work vehicle 1 as shown in FIG. 1 that has two implement lift arms 7 connected at a distal end to an implement 5, wherein each arm 7 is connected at a proximal end to pivotally move about a pivot axis P about or on the body of the work vehicle. Two hydraulic tilting cylinders 9 are connected at one proximal end to the body of the work vehicle and at the other distal end to either a corresponding one of the two lift arms 7 or to a coupler 10 or mounting plate or mount as is conventionally known in the art. One skilled in the art would realize that a coupler, mounting plate, and mount are equivalent terms for describing various structures that accomplish the same function of connecting the implement 5 to the distal ends of the lift arms 7. The tilting cylinders 9 are part of a hydraulic circuit for maneuvering (i.e. tilting) and/or powering the implement 5 as will be described later. Preferably, work vehicle 1 is mobile and has wheels 3, although one skilled in the art would appreciate that the work vehicle 1 could be a tracked vehicle or a stationary piece of mechanized equipment. Work vehicle 1 typically has its own motor (not shown) and has a cab 11, wherein an operator sits and operates the work vehicle 1 via various controls housed in the cab.

FIG. 1 illustrates one preferred embodiment of the present invention wherein the work vehicle 1 is a skid steer loader; however, one skilled in the art would appreciate that other embodiments of the work vehicle, such as tractors, front end loaders, graders, plowing vehicles, digging vehicles, and the like, could be suitably practiced as work vehicles in accordance with the present invention. Likewise, the implement 5 carried by the work vehicle 1 is not limited to the loader bucket shown in FIG. 1. Other implements can be used and are included within the scope of the invention. For example, when the work vehicle is a grader, the implement would be a grading implement, and when the work vehicle is a plowing vehicle the implement would be a plowing implement. Furthermore, a tractor or a skid steer loader could be rigged to carry an auger, or a broom, or some other desirable working implement that is hydraulically maneuvered, powered and/or controlled.

One skilled in the art would also recognize that work vehicle 1 may be constructed to have only one lifting arm 7 and only one corresponding implement cylinder 9 so that the one lifting arm is connected to and carries the implement 5 with or without a coupler, and the one implement cylinder maneuvers and/or powers the implement.

Figure 2:
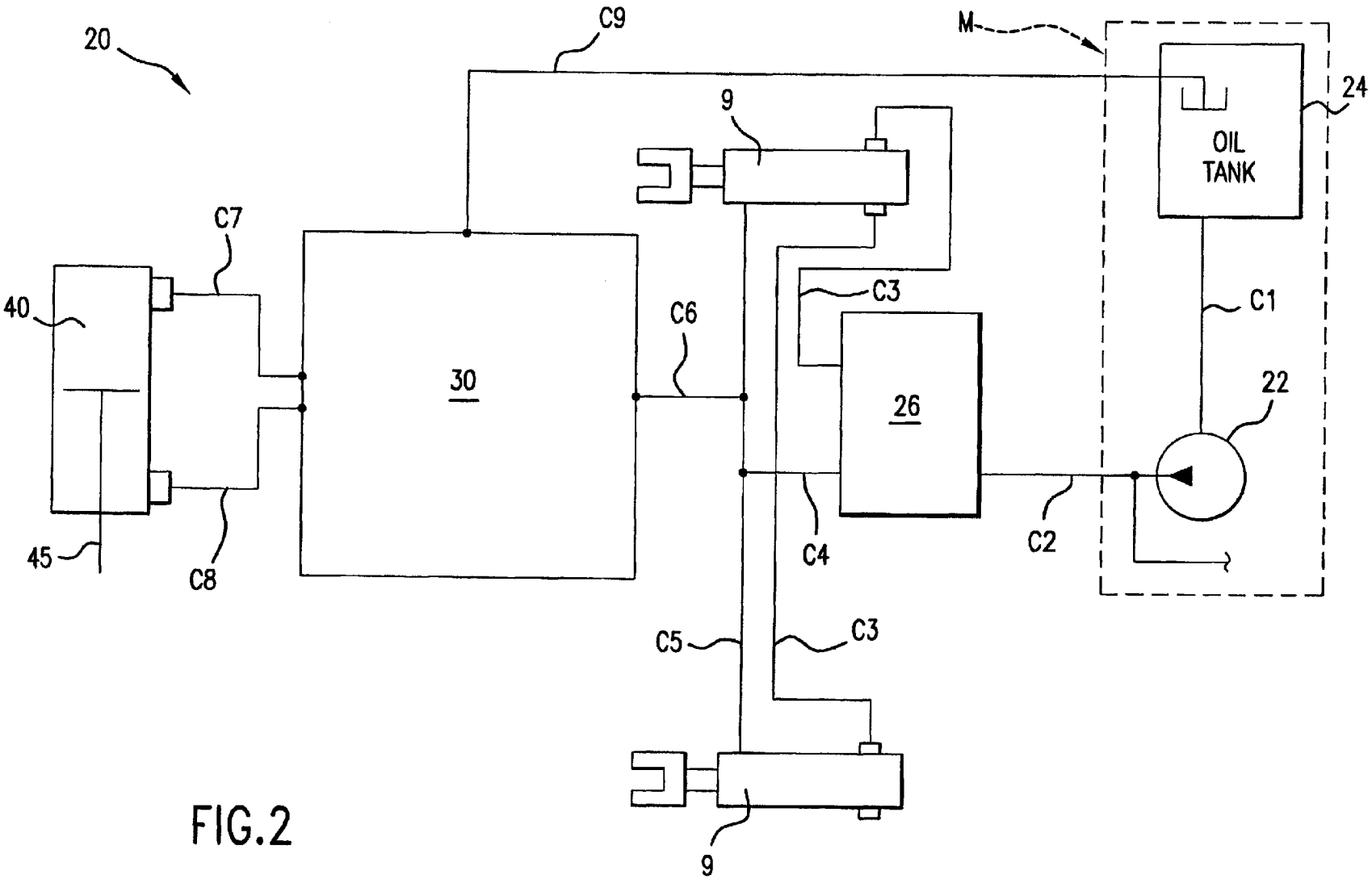
FIG. 2 is a schematic diagram of the hydraulic implement circuit carried by the work vehicle of the first preferred embodiment.
Figure 3:
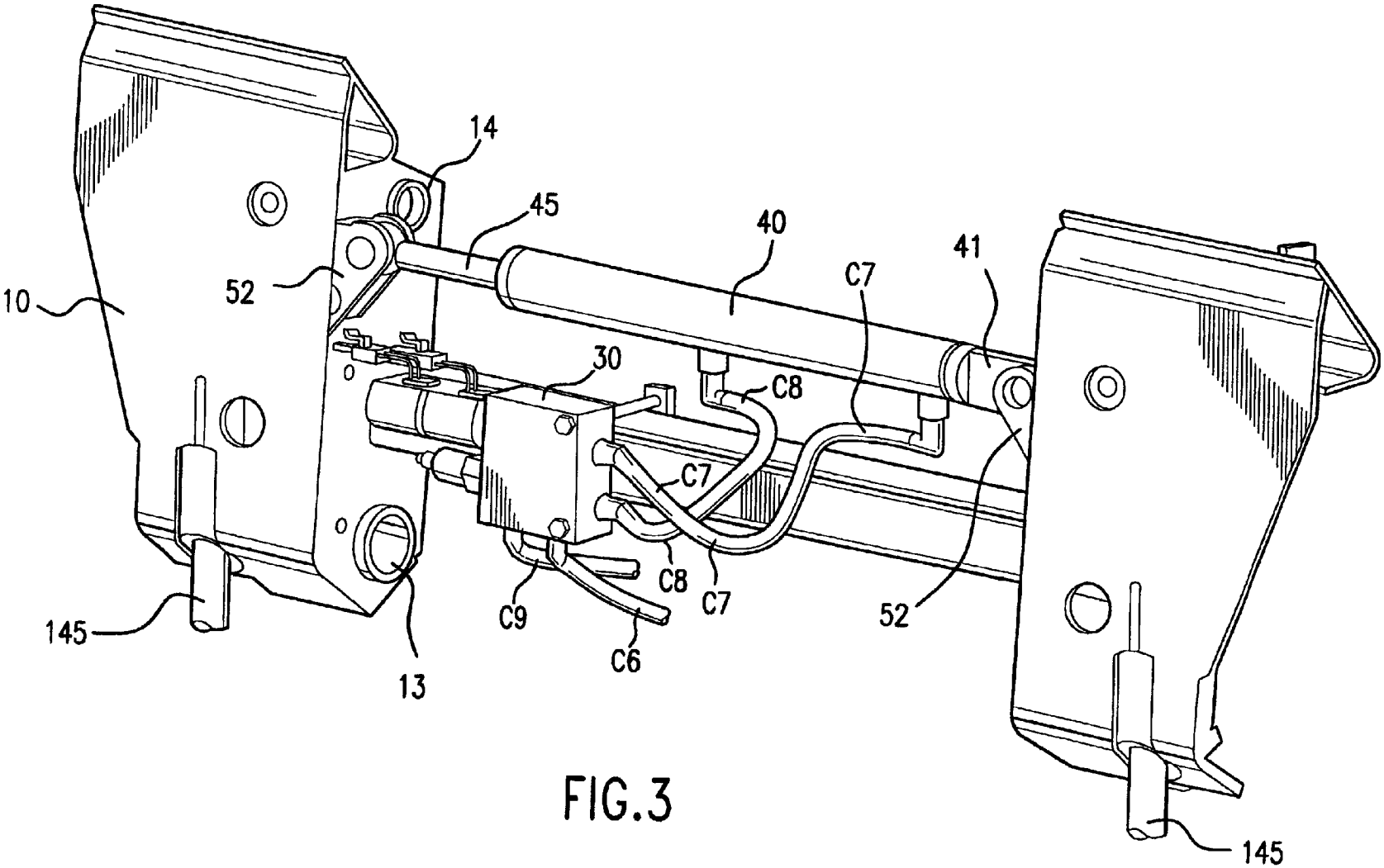
FIG. 3 is a partial cut away view of the coupler of the work vehicle, thereby showing the latch valve of the hydraulic implement circuit.

FIGS. 2 and 3 illustrate various aspects of the hydraulic circuit for maneuvering or powering the implement carried by the work vehicle. FIG. 2 is a schematic diagram of the hydraulic implement circuit 20 in accordance with the present invention. Hydraulic implement circuit 20 is constructed with implement cylinders 9 incorporated therein so as to be able to operate each implement cylinder to effect maneuvering and/or powering of the implement 5 connected, with or without a coupler, to the distal end of lifting arms 7. FIG. 3 shows the relationship of the latch valve 30 associated with coupler 10.

Hydraulic implement circuit 20 includes hydraulic pump 22 operationally connected to hydraulic reservoir 24 via hydraulic conduit C1. Pump 22 and reservoir 24 may be connected solely to the hydraulic circuit 20, or they may be connected to and be part of a main hydraulic circuit M for the work vehicle, wherein main circuit M hydraulically controls and operates other hydraulic devices such as power steering, power brakes, secondary hydraulic work implements, etc. For the purposes of this disclosure, the term "hydraulic conduit" and "conduit" are meant to be equivalent and interchangeable terms. Pump 22 provides hydraulic fluid via conduit C2 to the main control valve 26, which controls hydraulic fluid flow to implement cylinders 9 via conduit C3 and directly to latch valve 30 via conduits C4, C5 and C6. As evident from FIG. 2, hydraulic fluid also flows from cylinders 9 to latch valve 30 via conduits C5 and C6. Conduits C5 and/or C6 and C9 may run along one of the lift arms 7 to latch valve 30, which is either preferably associated with coupler 10 or disposed on lift arm 7.

The detailed operation of latch valve 30 will be described thoroughly later. Simply stated, latch valve 30 receives hydraulic fluid intake via conduit C6 and directs hydraulic fluid flow to latch cylinder 40 via conduit C7 in a selective manner. Latch valve 30 also receives fluid flow back from latch cylinder 40 via conduit C8, and permits hydraulic fluid to return to reservoir 24 via drain C9.

In one preferred embodiment of the present invention, when the latch cylinder 40 is activated to extend the latch pin or piston 45, the pin or piston 45 seats into a coupling portion (not shown) of the implement 5 so that the implement is securely attached to either the coupler 10 or directly to the lifting arms 7 as is conventionally known in the art. As indicated in FIG. 3, coupler 10 generally has a portion 13 for coupling to the distal end of a lifting arm 7 and a portion 14 for coupling to a distal end of an implement cylinder 9 as is known in the art.

When the latch cylinder 40 is deactivated, thereby retracting the pin or piston 45 from within the coupling portion of the implement 5, the implement is no longer securely attached to the coupler 10 or the lifting arms 7. In other words, latch pin or piston 45 is the means by which the implement 5 is secured to the lifting arms 7 directly, or indirectly to the lifting arms 7 by means of the coupler 10, as is generally known in the art. Examples of latch pin coupling mechanisms wherein a hydraulically activated pin engages a corresponding coupling portion of an implement and/or coupler or lifting arm are disclosed in U.S. Pat. Nos. 3,204,793; 3,272,264; 4,586,867; 5,310,275; 5,769,596; 6,132,131; and 6,332,747 B 1, each of which is incorporated herein by reference in its entirety for all that it discloses.

Figure 4:
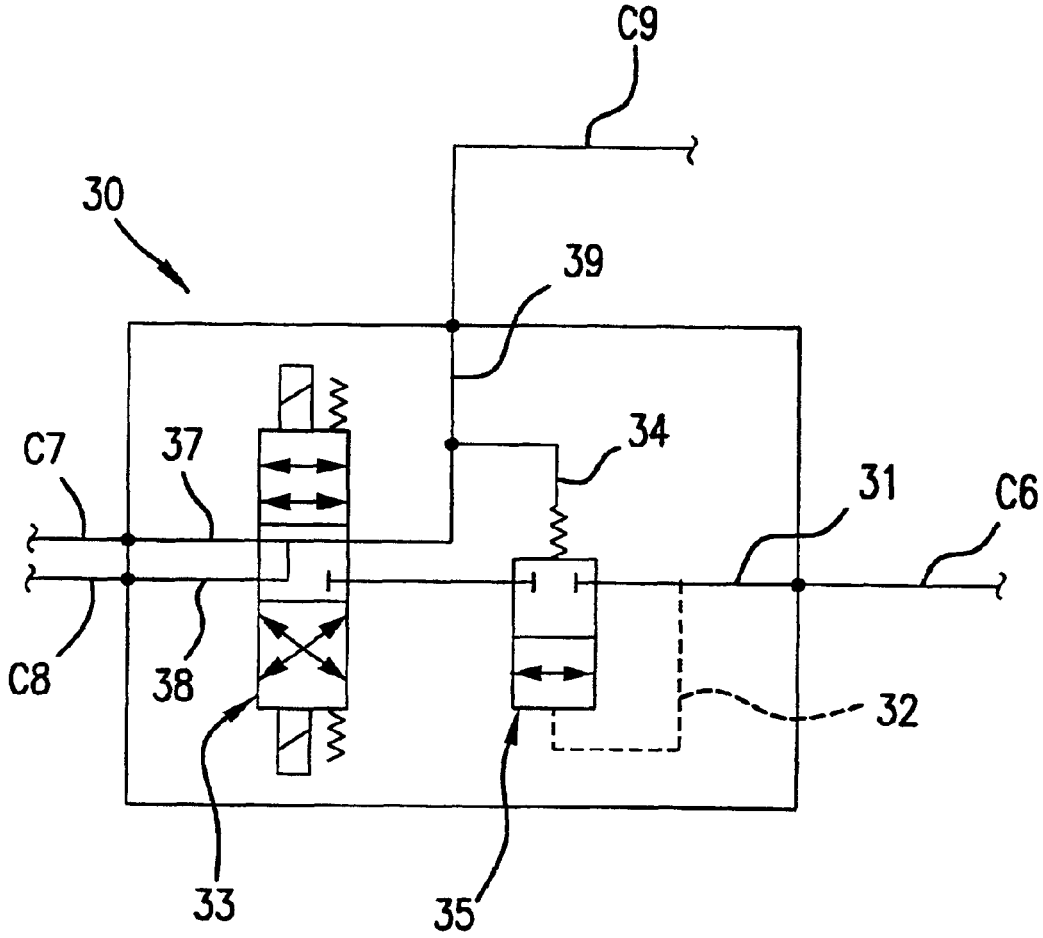
FIG. 4 is a functional schematic of the latch valve with integral sequence valve mechanism in accordance with the present invention.

FIG. 4 illustrates schematically the special features of the latch valve 30, which is a solenoid activated spool valve with integral sequence valve structure. Latch valve 30 with integral sequence valve is a single integrated spool valve structure as shown in FIG. 3; however, to facilitate an easy understanding of the latch valve mechanism, latch valve 30 is schematically represented in FIG. 4 as a solenoid operated spring biased 4/3 valve mechanism 33 that is in parallel with sequence valve mechanism 35. Sequence valve mechanism 35 receives hydraulic fluid from conduit C6 via intake 31. Sequence valve mechanism 35 behaves as a pilot operated check valve that is controlled by pilot pressure input 32 so that when there is a sufficient hydraulic pressure load in intake 31, valve mechanism 35 diverts hydraulic fluid flow to 4/3 valve mechanism 33. The minimum threshold hydraulic pressure load needed to open valve mechanism 35 is set by the hydraulic pressure load sensed in conduit 34 and the pressure load bias of a spring mechanism that is part of valve mechanism 35; however, the pressure load in conduit 34 is typically very low or almost zero. Consequently, the minimum threshold pressure load is most often approximately equal to the pressure load bias of the spring mechanism. When there is insufficient hydraulic load in pilot pressure input 32, valve mechanism 35 remains closed and no hydraulic fluid flows to the 4/3 valve mechanism 33. This feature is important because the latch valve 30 must be in a closed state in order for implement cylinders 9 to operate in a normal fashion to tilt the implement 5. Lastly, drain 39 is connected to conduit C9 so that hydraulic fluid leaving the drain can flow back to reservoir 24.

The 4/3 valve mechanism 33 behaves as a load-free-in-center-valve and receives hydraulic fluid from the sequence valve mechanism 35 when pilot pressure input 32 senses a hydraulic pressure load that exceeds a threshold pressure load. Once this first condition has been met (i.e., input 32 senses a pressure load that exceeds a threshold pressure load), then valve mechanism 33 receives high pressure hydraulic fluid intake from valve mechanism 35. Consequently, during the first condition, a simultaneous electrical solenoid activation of 4/3 valve mechanism 33 may control the selective operation of valve mechanism 33 to direct hydraulic fluid flow to latch cylinder 40 via pressure output 37 of latch valve 30 connected to conduit C7. The condition wherein the 4/3 valve mechanism 33 is electrically operated to direct hydraulic fluid to latch cylinder 40 is a second required condition that is needed in order to hydraulically power the cylinder 40 to extend pin or piston 45. In other words, latch cylinder 40 can be operated to extend pin or piston 45 only when both the first and second conditions are met simultaneously. When pin or piston 45 is in the extended position, it latches or locks into a corresponding coupling portion on the implement 5 as is conventionally known in the art.

FIGS. 3 and 4 also show that hydraulic fluid can flow from latch cylinder 40 back through 4/3 valve mechanism 33 via conduit C8 and drain 39 to conduit C9 and reservoir 24. Thus, the electrical solenoid activation of the 4/3 valve mechanism 33 may selectively operate valve mechanism 33 to direct hydraulic fluid flow to drain latch cylinder 40 so that pin or piston 45 is retracted and unlatched from the coupling portion of implement 5.

Figure 5:
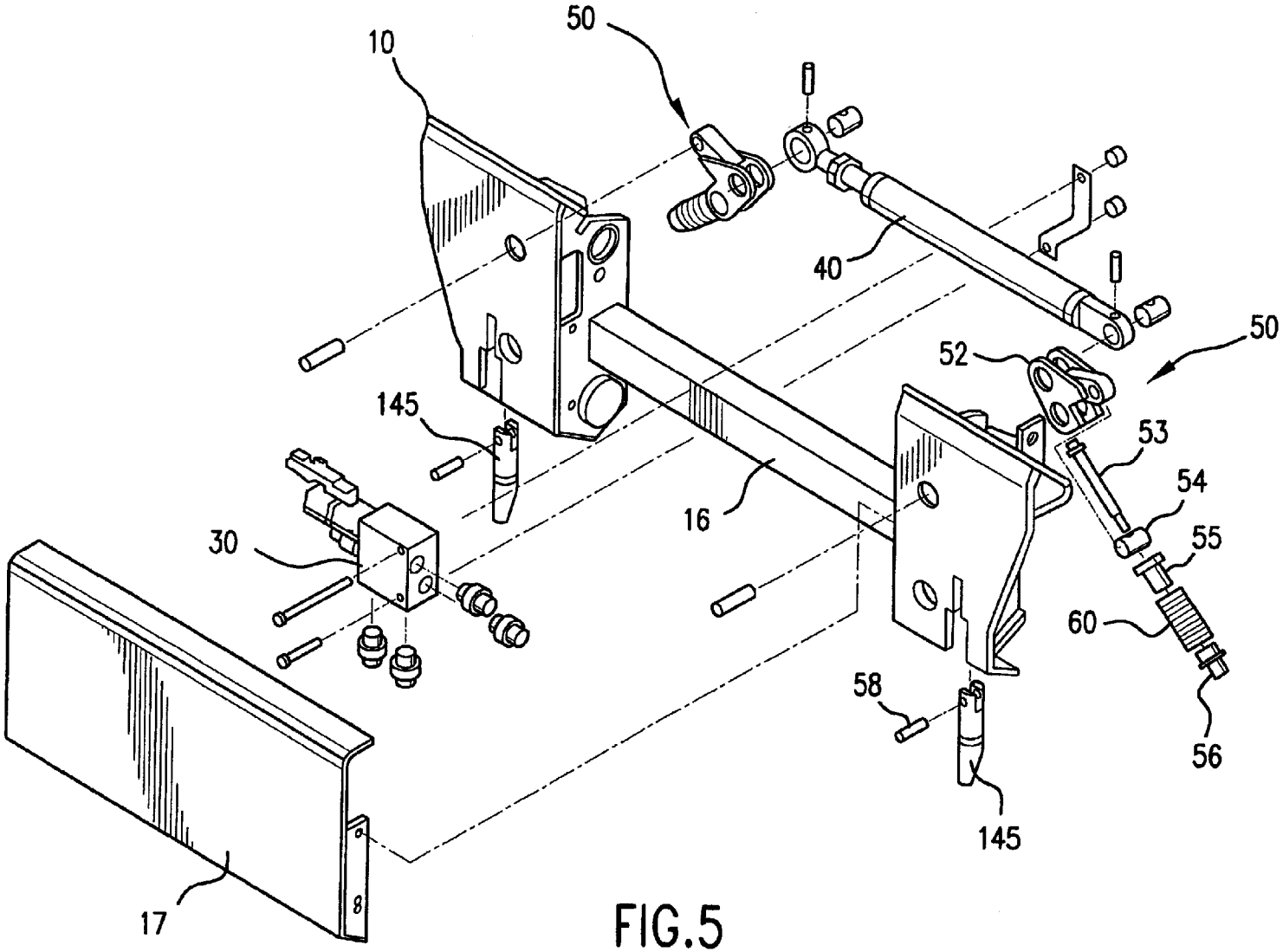
FIG. 5 is an exploded view of the coupler of the work vehicle, showing the structure of the connection assembly.

In a preferred embodiment of the latch mechanism in accordance with the present invention, a single latch cylinder 40 as shown in FIGS. 3 and 5 is disposed along or on coupler 10 so that the cylinder 40 is positioned and connected between two lever arms 52. Both the latch valve 30 and the latch cylinder 40 are mounted to a mounting portion 16 of the coupler 10. Coupler 10 includes a face plate 17 that is secured to form a face of the coupler and to protect the mounting portion 16, the latch valve 30 and the latch cylinder 40. Consequently, activation of the cylinder 40 to extend pin or piston 45 results in the movement of two remote latch pins 145. In other words, cylinder 40 is mechanically connected to two remote latch pins 145 by a connection assembly 50 so that movement in pin or piston 45 effects a corresponding simultaneous movement in each remote latch pin 145 because the pin or piston 45 is connected directly to one of the lever arms 52 and a base portion 41 of the cylinder 40 is directly connected to the other lever arm 52.

FIG. 5 illustrates that the connection assembly 50 connects the latch cylinder 40 to each of the remote latch pins 145. One preferred embodiment of the connection assembly is shown and will be described, although one skilled in the art would realize that other mechanical structures could be used without departing from the scope of the present invention so long as such alternate connection assemblies perform the same function as the connection assembly 50. Specifically, connection assembly 50 includes one lever arm 52 attached to the pin or piston 45 and another lever arm 52 connected to a base portion 41 of latch cylinder 40. To each lever arm 52, there is an attached central pin 53 over which a seat 54, a spring abutting member 55, and a spring 60 are positioned. One end of the central pin 53 is provided with a connecting portion for connecting to a corresponding portion of a spring abutting end member 56 so that spring 60 is sandwiched between the spring abutting member 55 and the spring abutting end member 56. A remote pin 145 is connected to a portion of the spring abutting end member 56 by a fastener 58.

Specifically stated, connection assembly 50 provides a spring biasing force for maintaining the position of the pin or piston 45 when the latch cylinder 40 is in a relaxed state as described later. In addition, connection assembly 50 operates so that each remote latch pin 145 is extended when pin or piston 45 is extended so that each remote latch pin 145 engages and latches into a corresponding coupling portion on the implement 5 as is conventionally known in the art, thereby effecting a secure connection of the implement 5 at one end of the lifting arms 7. In one preferred embodiment, implement 5 is connected directly to the lifting arms 7, but it is particularly advantageous to connect the implement to coupler 10, which is connected to the distal ends of the two lifting arms 7.

Although FIG. 3 illustrates two remote latch pins 145, one corresponding respectively to the left and right lifting arms 7, one skilled in the art would recognize that the present invention can be practiced wherein the latch cylinder 40 is connected to move only a single remote latch pin 145. In addition, one skilled in the art would realize that although lever arms 52 are part of the connection assembly 50 for connecting cylinder 40 to latch pins 145, additional connecting members may be used to connect the lever arms 52 to remote latch pins 145. On the other hand, one skilled in the art would also appreciate that each lifting arm 7 could be constructed to include the latch cylinder 40 shown in FIG. 3 so that cylinder 40 is disposed in the lifting arm and not in the coupler. Thus, when the latch cylinder is activated to extend pin or piston 45 between lever arms, each latch cylinder in the corresponding lifting arm would effect movement of only one corresponding remote latch pin using a similar or different connection assembly than that shown in FIG. 5.

The operation of the latch mechanism in accordance with the present invention, which is integrated with the hydraulic implement circuit 20, is described as follows. The latch mechanism begins with latch cylinder 40 in a deactivated state with the pin or piston 45 in the retracted or unlatched position. To extend pin or piston 45 into the extended or latched position it is necessary to activate the latch cylinder 40. To activate the latch cylinder 40, it is necessary to satisfy the first condition wherein the hydraulic pressure load in pilot pressure input 32 exceeds a threshold pressure load. Typically, the sequence valve mechanism 35 can be set so that the threshold pressure load is set to just below about 50–100 psi, which is the relief pressure for the main hydraulic implement circuit 20. To generate a pilot pressure load in input 32 that exceeds this threshold load, it is necessary to fully retract the implement cylinders 9 to the full stop position, which requires the operator of work vehicle 1 to perform a first action (i.e., operate the implement circuit to fully retract the implement cylinders). While the implement cylinders 9 are in the fully retracted state, an "over-relief" pressure load is generated in conduits C5 and C6 that is transmitted to intake 31 and pilot pressure input 32. Because the over-relief pressure is greater than the threshold pressure, sequence valve mechanism 35 operates to provide pressurized hydraulic fluid to 4/3 valve mechanism 33.

While the 4/3 valve mechanism 33 is receiving pressurized fluid from sequence valve mechanism 35, the operator must perform a second action to activate the latch cylinder 40. The second action must occur simultaneously with the performance of the first action, which provides a fail safe mechanism to decrease the likelihood of accidentally activating the latch mechanism of the present invention. The second action amounts to activating a switch in the cab 11, for example, to electrically operate the solenoids of the latch valve 30 to selectively operate the 4/3 spool valve mechanism 33 to direct the hydraulic fluid to latch cylinder 40, thereby powering the latch cylinder to extend the latch pin or piston 45 into the latched or secured position. As described above, pin or piston 45 may directly extend into a coupling portion of either the implement 5, or the extending of pin or piston 45 may further effect the extension of one or two remote latching pins 145 that extend into a latched or secured position in a coupling portion of the implement 5.

Once the latch cylinder 40 has been activated to extend the latch pin or piston 45 so that the implement 5 is securely latched at the distal end of lifting arms 7, with or without the use of a coupler, it is not necessary to maintain the over-relief pressure load to the latch valve 30 when lever arms 52 and remote latch pins 145 are used in the preferred embodiment. As shown in FIG. 3, pin or piston 45 is connected to one lever arm 52 and another lever arm 52 is connected to the other end or base 41 of latch cylinder 40. The center condition of the 4/3 spool valve mechanism 33 makes it possible for latch cylinder 40 to relax with its work ports open to the drain C9 and reservoir 24. Under these relaxed conditions, lever arms 52, which are spring biased, seat into their natural over-center position thereby maintaining the remote latch pins 145 in the latched position by maintaining the position of pin or piston 45. One skilled in the art would understand that this desirable feature is attained only by the preferred embodiment of the present invention where lever arms 52 and remote latch pins 145 are used.

To disengage the latch mechanism, it is necessary to repeat the above steps. As described above, when the latch cylinder 40 is in a relaxed state the remote latch pins 145 are maintained in the extended state to effectively latch the implement 5 to the distal ends of the lifting arms 7 because the lever arms 52 maintain the remote latch pins 145 in the latched position. To retract the remote latch pins 145, it is necessary to retract the pin or piston 45. Latch cylinder 40 can be made to fully retract the pin or piston 45 by selectively operating the solenoids of latch valve 30 so that the 4/3 spool valve mechanism 33 permits fluid to drain from the latch cylinder to the drain C9. However, the 4/3 spool valve mechanism 33 can only be operated to permit draining of hydraulic fluid from latch cylinder 40 when pressurized hydraulic fluid from sequence valve mechanism 35 is supplied to the spool valve mechanism 33. In other words, deactivation of the latch cylinder 40 requires two simultaneous conditions to be met. First, the pilot pressure load in pilot pressure input 32 must exceed a threshold pressure load, which occurs by fully retracting the implement cylinders 9. Thus, an operator of the work vehicle 1 must perform a first action, which is to fully retract the implement cylinders 9 so that the pressure load sensed by pilot pressure input 32 exceeds the threshold pressure load and sequence valve mechanism 35 supplies pressurized hydraulic fluid to 4/3 spool valve mechanism 33. In a second simultaneous action that occurs while the implement cylinders 9 are fully retracted, the operator must activate a switch in cab 11, for example, to electrically operate the solenoids of the latch valve 30 to operate the 4/3 spool valve mechanism 33 to drain hydraulic fluid from latch cylinder 40, thereby causing the latch cylinder 40 to retract the pin or piston 45 into the unlatched or unsecured position. In this manner, the latch cylinder 40 is made to fully retract, thereby fully retracting pin or piston 45 from the coupling portion of the implement 5. In the preferred embodiment of the invention, wherein remote latch pins 145 are used, remote latch pins 145 fully retract when pin or piston 45 fully retracts, thereby disengaging the remote latch pins 145 from the coupling portion of the implement 5.

While the present invention and its operation has been described with reference to certain preferred embodiments, one of ordinary skill in the art will recognize that additions, deletions, substitutions, modifications, and improvements can be made while remaining within the spirit and scope of the present invention as defined by the appended claims.

What is claimed is:

1. A work vehicle comprising at least one implement lifting arm connectable to an implement and a hydraulic implement circuit for powering the implement, the hydraulic implement circuit having a hydraulic pump and a hydraulic fluid reservoir connected to hydraulic conduits of the hydraulic implement circuit, wherein the hydraulic pump is connected to pump hydraulic fluid from the reservoir through the conduits of the hydraulic implement circuit, wherein the implement circuit further comprises:

at least one hydraulic implement cylinder for maneuvering the implement, the at least one implement cylinder being connected to the conduits of the implement circuit so as to be powered by the hydraulic pump; and a latch mechanism comprising a latch valve and a latch cylinder, wherein the latch valve is connected to receive hydraulic fluid from the at least one implement cylinder, and the latch cylinder is connected to receive hydraulic fluid from the latch valve, wherein the latch mechanism operates to securely connect the implement at one end of the at least one lifting arm when the at least one implement cylinder is in a fully retracted state and the latch valve is operated to direct hydraulic fluid to the latch cylinder.

2. A work vehicle as recited in claim 1, wherein the latch valve is disposed along a coupler.

3. A work vehicle as recited in claim 1, wherein the latch valve is a solenoid activated spool valve including an integral sequence valve.

4. A work vehicle as recited in claim 1, wherein the latch valve is a solenoid-operated, spring-biased, 4/3-spool-valve mechanism in parallel with a sequence-valve mechanism.

5. A work vehicle as recited in claim 1, wherein the latch cylinder includes a piston that moves into an extended position when the latch mechanism operates to securely connect the implement at one end of the at least one lifting arm.

6. A work vehicle as recited in claim 5, wherein at least one remote latch pin is mechanically connected by a connection assembly to the piston so that the at least one remote latch pin moves into an extended position to securely connect the implement at one end of the at least one lifting arm when the piston moves into the extended position.

7. A work vehicle as recited in claim 5, wherein two remote latch pins are mechanically connected by a connection assembly to the piston so that each remote latch pin moves into an extended position to securely connect the implement at one end of the at least one lifting arm when the piston moves into the extended position.

8. A work vehicle as recited in claim 6, wherein the connection assembly includes a first lever arm connected to the piston and a second lever arm connected to a base of the latch cylinder so that the at least one remote latch pin is maintained in the extended position when the latch cylinder is relaxed.

9. A hydraulic circuit for a work vehicle, the hydraulic circuit comprising:

a hydraulic pump and a hydraulic fluid reservoir connected to hydraulic conduits of the hydraulic implement circuit, wherein the hydraulic pump is connected to pump hydraulic fluid from the reservoir through the conduits of the hydraulic implement circuit;

a first hydraulic implement cylinder arranged to maneuver the implement, the first implement cylinder being connected to the conduits of the implement circuit so as to be powered by the hydraulic pump; and a latch mechanism including a latch valve and a latch cylinder, wherein the latch valve is connected to receive hydraulic fluid from the at least one implement cylinder, and the latch cylinder is connected to receive hydraulic fluid from the latch valve, wherein the latch mechanism operates to a latching position when the at least one implement cylinder is in a fully retracted state and the latch valve is operated to direct hydraulic fluid to the latch cylinder.

10. A hydraulic circuit for a work vehicle as recited in claim 9, wherein the latch valve is disposed along a coupler.

11. A hydraulic circuit for a work vehicle as recited in claim 9, wherein the latch valve is a solenoid-activated spool valve including an integral sequence valve.

12. A hydraulic circuit for a work vehicle as recited in claim 9, wherein the hydraulic circuit is hydraulically connected to a main hydraulic circuit of the work vehicle so that the pump and the reservoir are connected to and are part of the main hydraulic circuit.

13. A hydraulic circuit for a work vehicle as recited in claim 9, wherein the latch cylinder includes a piston that moves into an extended position when the latch mechanism operates to securely connect the implement at one end of the at least one lifting arm.

14. A hydraulic circuit for a work vehicle as recited in claim 13, wherein two remote latch pins are mechanically connected by a connection assembly to the piston so that each remote latch pin moves into an extended position to securely connect the implement at one end of the at least one lifting aim when the piston moves into the extended position.

15. A hydraulic circuit for a work vehicle as recited in claim 14, wherein the connection assembly includes a first lever arm connected to the piston and a second lever arm connected to a base of the latch cylinder so that the each remote latch pin is maintained in the extended position when the latch cylinder is relaxed.

16. A hydraulic latch mechanism hydraulically connectable to a hydraulic circuit of a work vehicle, wherein the hydraulic circuit is connectable to provide hydraulic fluid to power the hydraulic latch mechanism, wherein the latch mechanism comprises:

a solenoid-activated latch valve including an integral, sequence-valve mechanism wherein the latch valve includes an intake connectable to receive hydraulic fluid from the hydraulic circuit so that the integral, sequence-valve mechanism senses hydraulic pressure load provided by the hydraulic circuit to the intake; and a hydraulic latch cylinder connected to receive hydraulic fluid from the latch valve so that (1) when hydraulic pressure load provided by the hydraulic circuit to the intake exceeds a minimum threshold pressure load, which is exceeded when at least one implement cylinder of the hydraulic circuit is in a fully retracted state and (2) when a solenoid mechanism of the latch valve is selectively activated, then hydraulic fluid is directed by the latch valve to the latch cylinder to activate the latch cylinder to extend a first pin to a latching position.

17. A hydraulic latch mechanism as recited in claim 16, wherein the first pin is mechanically connected by a connection assembly to two remote pins so that when the first pin extends, the two remote pins extend simultaneously to a latching position.

18. A hydraulic latch mechanism as recited in claim 16, wherein the latch valve and the latch cylinder are disposed along a mount.

* * * * *